US005380493A

United States Patent [19]

Chavez et al.

[11] Patent Number: 5,380,493

[45] Date of Patent: Jan. 10, 1995

[54] CELL WELL PLATE HOLDER AND WELL MARKING SYSTEM

[76] Inventors: Jeffery B. Chavez, 5627 Timber Rain, San Antonio, Tex. 78250; Christopher P. D. Jacobs, 6711 Country Breeze, San Antonio, Tex. 78240

[21] Appl. No.: 859,124

[22] Filed: Mar. 27, 1992

[51] Int. Cl.[6] ..... B01L 9/00

[52] U.S. Cl. ..... 422/104; 211/41; 248/291; 422/99

[58] Field of Search ..... 422/82.09, 82.05, 104, 422/100, 102, 859, 124, 99; 436/809; 211/49.1, 41, 42–44, 59.2, 71; 248/291, 447, 479; 250/328; 356/436

[56] References Cited

U.S. PATENT DOCUMENTS

| | | | |
|---|---|---|---|
| 1,485,915 | 3/1924 | Hammel | 248/479 |
| 1,488,282 | 3/1924 | Phillips | 211/42 |
| 2,092,665 | 9/1937 | Davis | 248/447 |
| 2,117,667 | 5/1938 | Johnson | 211/42 |
| 3,408,033 | 10/1968 | Kochevar et al. | 248/479 |
| 3,718,308 | 2/1973 | Hainault | 211/42 |
| 3,722,719 | 3/1973 | Frank | 250/328 |
| 3,844,428 | 10/1974 | Olsen | 250/328 |
| 3,876,380 | 4/1975 | Helriegel | 422/104 |
| 4,057,148 | 11/1977 | Meyer et al. | 250/328 |
| 4,105,182 | 8/1978 | Jacobson | 211/42 |
| 4,109,889 | 8/1978 | Durket | 248/447 |
| 4,369,948 | 1/1983 | Krauss et al. | 248/447 |
| 4,394,580 | 7/1983 | Gielisse | 356/30 |
| 4,678,894 | 7/1987 | Schafer | 436/809 |
| 4,748,125 | 5/1988 | Pizzolante | 422/104 |
| 4,816,695 | 3/1989 | Lavin | 356/436 |
| 4,960,256 | 10/1990 | Chihara et al. | 248/291 |
| 4,961,646 | 10/1990 | Schrammli et al. | 356/328 |
| 4,987,306 | 1/1991 | Dodson | 250/328 |
| 5,039,860 | 8/1991 | Yrjönen et al. | 250/328 |
| 5,043,581 | 8/1991 | Joss | 250/328 |
| 5,100,098 | 3/1992 | Hawkins | 248/291 |
| 5,106,047 | 4/1992 | Baer | 211/49.1 |

FOREIGN PATENT DOCUMENTS

| | | |
|---|---|---|
| 359550 | 9/1988 | European Pat. Off. . |

*Primary Examiner*—Robert J. Warden
*Assistant Examiner*—T. A. Trembley
*Attorney, Agent, or Firm*—Gunn, Lee & Miller

[57] ABSTRACT

A device for holding a laboratory cell well plate in a more accessible and visible position and for indicating which individual cell wells have been used or accessed during the experimental session. The device consists of an angled receiving face that supports and retains a cell well plate and an electronic array of detectors and indicators for identifying the use of specific cell wells on the cell well plate.

3 Claims, 5 Drawing Sheets

CELL WELL PLATE HOLDER AND WELL MARKING SYSTEM

BACKGROUND OF THE INVENTION

1. Field of the Invention

This invention relates generally to the positioning of laboratory sample containers into more accessible and usable orientations. The invention relates more specifically to securing laboratory cell well plates in an angled position appropriate for user viewing and access and to a means for identifying individual cell wells which have been accessed.

2. Background of the Invention

As the laboratory sciences have become more advanced, performing accurate experiments in ever more sterile environments has become increasingly necessary. When working in such sterile environments, as behind an enclosure or shield, researchers and technicians typically wear gloves, which makes it difficult to pick up small or flat items. At times, these gloves are even connected to the frame of the shield or the enclosure, thus making it even more difficult to pick up small or flat items or samples that cannot be disturbed when moved.

One such small, flat item is a specific type of laboratory sample container known as a cell well plate. Cell well plates are used in most experiments in the biology, biochemistry and genetic fields. The dimensions of a standard cell well plate are approximately 6 inches by 3 inches. The depth varies according to the number of indentations (cell wells) which vary from 6, 12, 24, 48 to 96 and are typically arranged in a rectangular array. These wells are on the top surface of the cell well plate and are used to deposit small samples of biological or chemical substances for mixing or observation. The wells themselves can hold a maximum of between 300 μl and 4 ml of sample. When in use, the plates are normally set flat on a counter behind a hood or shield. Consequently, they are very difficult to pick up when wearing gloves, and are especially difficult to pick up without disturbing the samples or causing the samples to spill out of their individual wells, thus ruining the experiment.

In addition to the difficulty of picking up the cell well plate, the ease of viewing each individual well is minimal when the plates are set flat on a counter behind a hood or shield. Because of the hood or shield barrier between the researcher and the cell well plate, the researcher is usually prevented from looking directly at the cell well plate from above. Thus, when a small (μl) amount of sample is placed in a well, the researcher cannot readily see the sample and, consequently, cannot see if a sample has already been added to an empty cell. Furthermore, it is difficult for the researcher to position a dispensing pipette over each individual well because he/she cannot easily see the boundaries of the well from the distance behind the hood or shield.

In addition to the problems associated with the appropriate positioning of a cell well plate, there are problems associated with keeping track of the individual cell wells that have been accessed during a test operation. A researcher may frequently be interrupted while in the process of placing samples in the wells or adding reactants to the samples. It is often not apparent at a glance which cell wells have been accessed and which have not. It would be advantageous to have a means for easily identifying the wells that have been accessed so that a researcher might readily continue a testing sequence after interruption.

Therefore, a need exists for a device that gives a researcher or technician the ability to position a cell well plate for better access to and a better view of the wells and samples on the cell well plate. In addition, a need exists for indicating which wells have been accessed by the researcher and those that have not.

SUMMARY OF THE INVENTION

This invention finds great utility incorporated with the use of standard laboratory cell well plates. In accordance with this invention, the cell well plate is placed on a holder. The portion of the holder that receives the cell well plate is angled to allow for easier visibility of each individual well and the samples placed within each well. This portion of the holder also has a retaining means that allows for the rigid positioning of the cell well plate on the holder in either a lengthwise or widthwise orientation. The holder is positioned and stabilized by a second part of the holder which is attached to the receiving portion of the holder.

In a first preferred embodiment of the invention, the stabilizing portion of the holder forms a base. The receiving face and the base are molded from a single piece of polymeric plastic with the receiving face being set a predetermined angle from the base. The preferred angle is 35 to 45 degrees, which creates a 145 to 155-degree angle between the receiving face of the holder and the surface upon which the holder is placed, although any acute angle can be employed as long as an obtuse angle is created between the receiving face of the holder and the surface upon which the holder is placed. In a second preferred embodiment of the invention, the stabilizing portion of the holder is attached to the top edge of the receiving face. Again, both portions are molded from a single piece of polymeric plastic with both portions set at a predetermined angle from each other. Any angle that maintains a 145 to 155-degree angle between the receiving face of the holder and the surface upon which the holder is placed can be utilized.

In accordance with another preferred embodiment of the invention, the receiving face and the stabilizing portion of the invention are adjustably connected. This allows the user to adjust the angle that the receiving face makes with the underlying surface so that the user can vary the angle and achieve better visibility of and/or accessibility to the cell well plate.

Any of the embodiments of the holder discussed above can also include a cell well plate lid holder. After accessing the samples, the cell well plates are typically covered by a lid to assure the samples are not contaminated. Often the researcher will mark important information on these lids when samples are being added to the cell well plate. Consequently, the cell well plate holder can incorporate a lid holder that will position the lid next to the cell well plate. In this position, the researcher can view both the plate and the lid simultaneously.

To identify which wells have been used when visual discrimination is difficult, or when the researcher has been disturbed and must return to the cell well plate at a later time, a well marking system can be incorporated with the preferred embodiments in either of two ways. Either a second plate holder shaped in the same configuration as the holders described above can be placed behind or inside the first holder, or bracket means to hold the well marking system in place can be added to the back of the holder supporting the cell well plate. With either means, the well marking system can be held in either the lengthwise or widthwise position to match the position of the cell well plate.

The well marking system described by the present invention may be comprised of one of two alternative means for identifying when a specific well contains a sample or has had a sample dispensed within it. In a first preferred embodiment, the well marking system comprises an array of LED/phototransistor pairs arranged to be positioned beneath each of the cell wells. An infrared LED, positioned on the pipette used to dispense the samples, illuminates the phototransistor beneath the well when the pipette enters that particular well and causes the LED beneath the well to illuminate. This illumination indicates the dispensing of a sample therein. Typically, cell well plates are constructed of transparent polymeric plastic that will transmit infrared and visual light.

In a second preferred embodiment, the well marking system comprises an array of infrared (IR) LED/-LED/phototransistor groups arranged to be positioned beneath each of the cell wells. The IR LED illuminates the clear base of the well positioned above it and reflects back down to the adjacent phototransistor. A change in the reflective character of the well due to the presence of a sample therein is detected by the phototransistor and, by appropriate circuitry, causes the adjacent LED (visual) to illuminate, indicating the presence of the sample therein.

Both well marking methods may be incorporated into a single apparatus and the system might be switchable between the two according to the samples being used and/or the preference of the test operator. Each well marking method also includes a means for clearing the array of indicator LEDs and for resetting the triggering circuitry.

Further objects and advantages of the invention will be readily apparent to those skilled in the art from the following detailed description, taken in conjunction with the annexed sheets of drawings.

DESCRIPTION OF PREFERRED EMBODIMENTS

Figure 1:
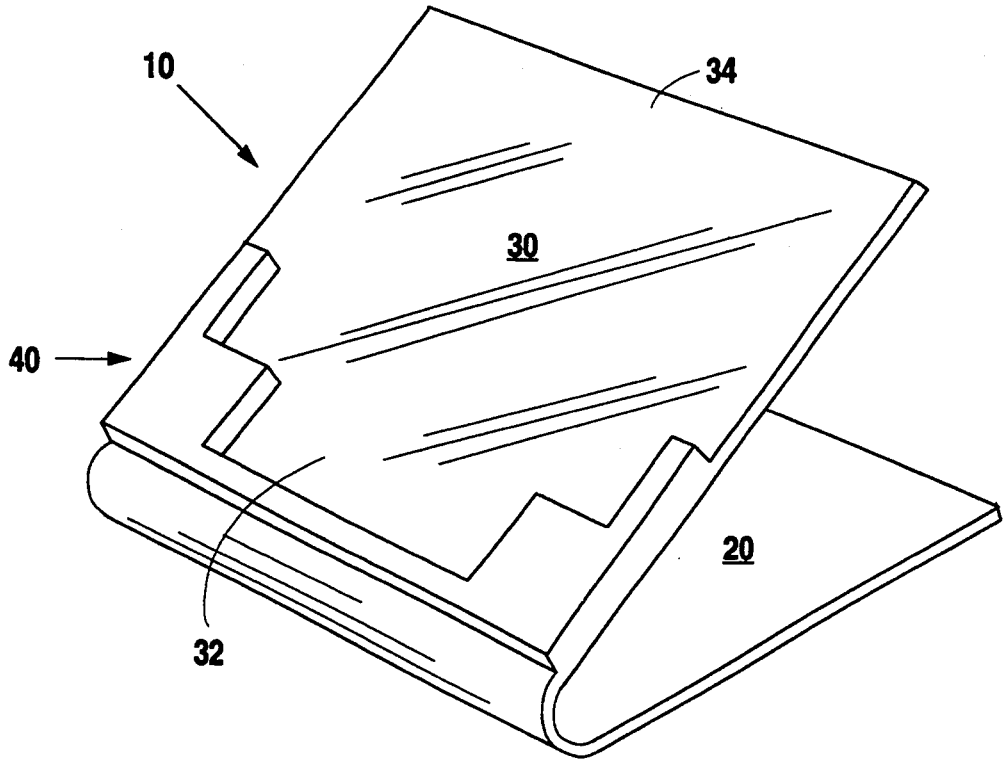
FIG. 1 is a persepective view of a first preferred embodiment of the cell well plate holder of the present invention.

FIG. 1 illustrates a first preferred embodiment of the cell well plate holder of the present invention. Cell well plate holder 10 has stabilizing portion 20 and receiving face 30 permanently attached to one another at an acute angle. The preferred angle is 35–45 degrees, but any angle can be used that effects an obtuse angle between receiving face 30 and the surface upon which the cell well plate holder is place. Attached to lower portion 32 of receiving face 30 is ledge 40 that enables the cell well plate (not shown) to be securely held against receiving face 30 in either a lengthwise or widthwise orientation ledge (40) is comprised of first end (41), second end (42) and mid-section (43). First end (41) is step shaped with first step (44) and second step (45). First step (44) has top edge (46) and side edge (47). Second step (45) has top edge (48) and side edge (49). Second end (42) of ledge (40) is step shaped and comprised of first step (31) and second step (32). First step (31) has top edge (29) and side edge (39). Second step (32) has top edge (37) and side edge (38). Mid-section (43) of ledge (40) is connected to side edge (49) of second step (45) of first end (41) of ledge (40) and side edge (38) of second step (32) of second end (42) of ledge (40).

Figure 3:
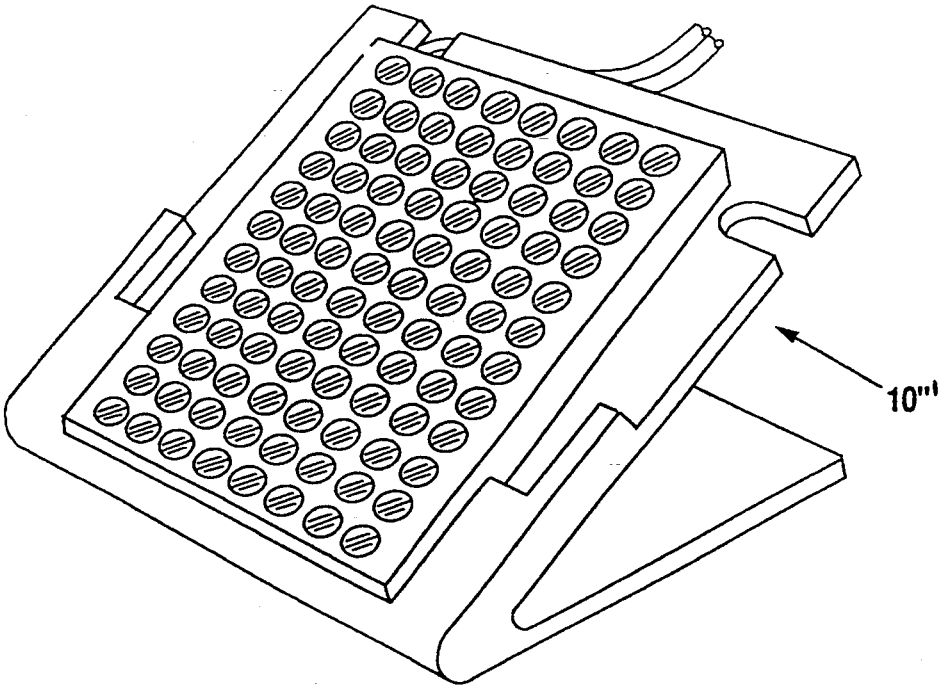
FIG. 3 is a perspective view of the cell well marking system positioned in a holder.

FIG. 3 illustrates a cell wall marking system (100) in the widthwise orientation on cell well plate holder (10‴). In the widthwise orientation, one of the shorter sides of a cell well marking system (100) is resting on mid-section (43) of ledge (40) with side edge (49) of second step (45) of first end (41) of ledge (40) and side edge (38) of second step (32) of second end (42) of ledge (40) restricting the lateral movement of the cell well plate (see FIG. 1). In the lengthwise orientation, one of the longer sides of the cell well marking system (100) is resting on top edge (48) of second step (45) of first end (41) of ledge (40) and top edge (37) of second step (32) of second end (42) of ledge (40) with side edge (47) of first step (44) of first end (41) of ledge (40) and side edge (39) of first step (31) of second end (42) of ledge (40) restricting the lateral movement of the cell well plate holder.

Figure 8:
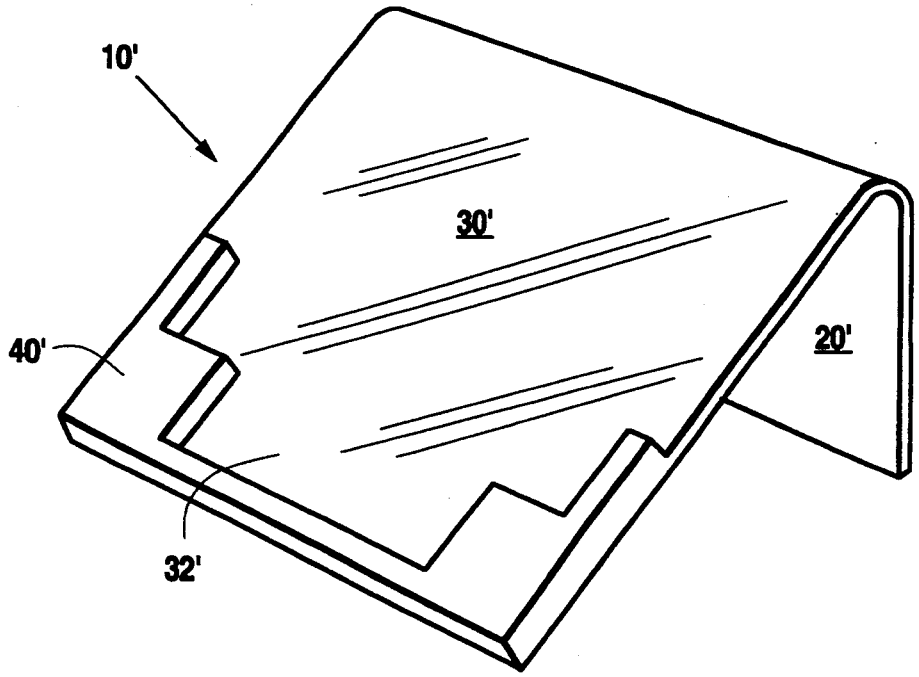
FIG. 8 is a perspective view of a second preferred embodiment of the cell well plate holder of the present invention.

FIG. 8 is a second preferred embodiment of the cell well plate holder of the present invention. Cell well plate holder 10′ includes receiving face 30′ and stabilizing portion 20′ permanently attached to one another at any angle to effect an obtuse angle between receiving face 30′ and the surface upon which the cell well plate holder is placed. Attached to lower portion 32′ of receiving face 30′ is ledge 40′ that enables cell well plate (not shown) to be securely held against receiving face 30′ in either a lengthwise or widthwise orientation.

Figure 4:
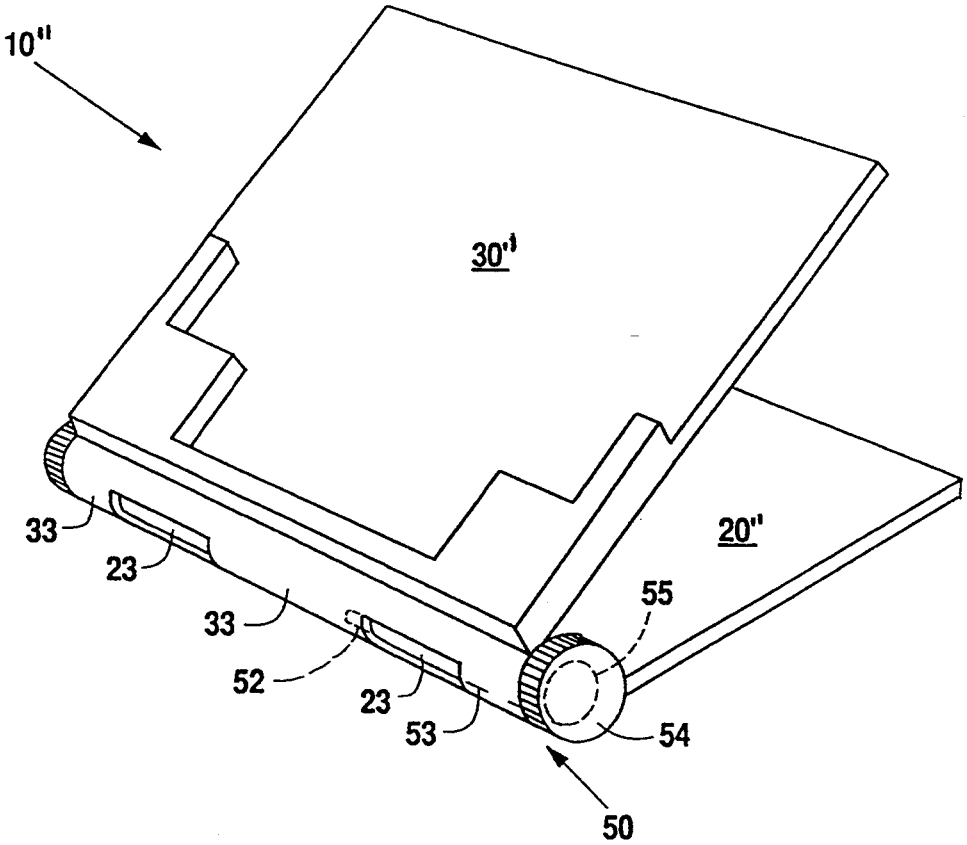
FIG. 4 is a perspective view of a third preferred embodiment of the cell well plate holder of the present invention.

FIG. 4 is a third preferred embodiment of the cell well plate holder of the present invention. Cell well plate holder 10″ includes receiving face 30″ adjustably attached to stabilizing portion 20″ by hinge segments 33 and 23. The angle between receiving face 30″ and stabilizing portion 20″ can be changed by utilizing angle adjustment mechanism 50. Angle adjusting mechanism 50 includes knob 54 with threaded aperature 55 and threaded screw 53 with head 52. In the preferred embodiment, head 52 is made of a soft, flexible material so that when tightened against hinge segment 23, it will not cause hinge segment 23 to break or splinter. Threaded screw 53 and knob 54 can be made from any material capable of being sterilized.

Figure 7:
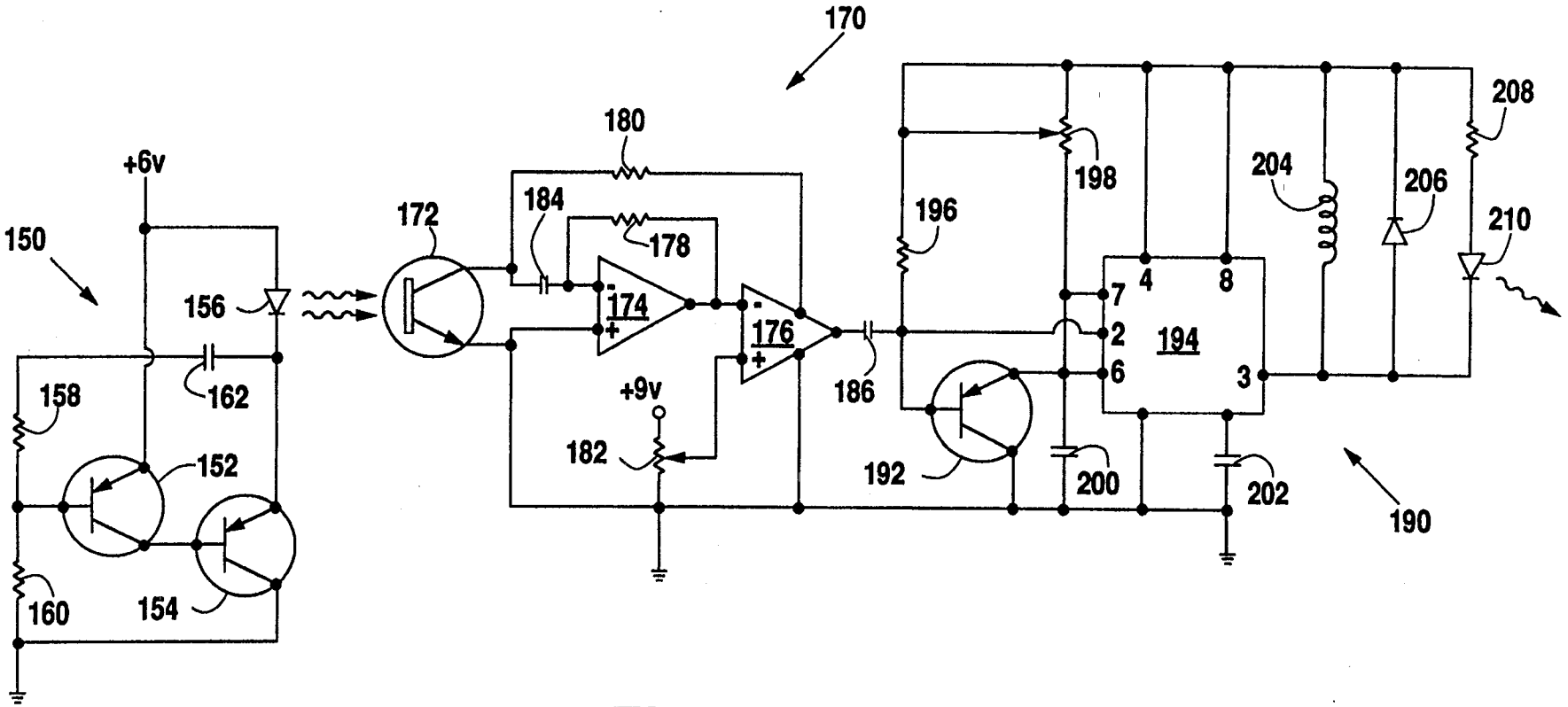
FIG. 7 is an electronic circuit schematic of one individual element of the cell well marking system.

To effect an adjustment of the angle between receiving face 30″ and stabilizing portion 20″, knob 54 is turned to loosen threaded screw 53 from threaded aperture 55. This decreases the pressure on hinge segment 23 from head 52 which allows receiving face 30″ to be readjusted to the desired angle. Once readjusted, knob 54 is turned in the opposite direction to cause screw 53 to re-engage threaded aperture 55 and in turn causes head 52 to be pulled tight against hinge segment 23 and to hold receiving face 30″ in place. This same type of adjustment mechanism can be added to the second preferred embodiment as shown in FIG. 7.

Figure 5:
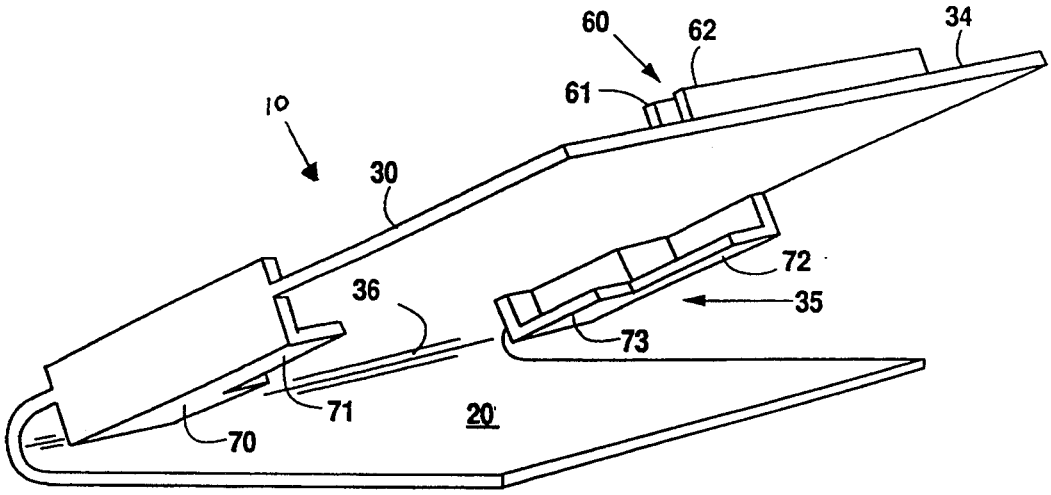
FIG. 5 is a perspective view of a cell well plate holder with four brackets positioned underneath the top surface for holding the cell well marking system in place.

FIG. 5 illustrates optional items that can be added to any of the embodiments shown in FIGS. 1, 2, 4 or 8. FIG. 3 shows these optional items as configured on the first embodiment described in FIG. 1. Lid holder 60 consists of two segments 61 and 62 attached to upper portion 34 of receiving face 30. Segments 61 and 62 can hold either the lengthwise or widthwise edge of a cell well lid (not shown) in a position adjacent to the cell well plate for simultaneous inspection of both the lid and the plate.

FIG. 5 also illustrates brackets 70–73 that can be incorporated into lower portion 36 of underneath side 35 of receiving face 30 for an alternate means for holding cell well marking system 100. Brackets 70 and 73 hold the cell well marking system 100 (not shown) in the lengthwise position. Brackets 71 and 72 hold the cell well marking system in the widthwise position.

Figure 2:
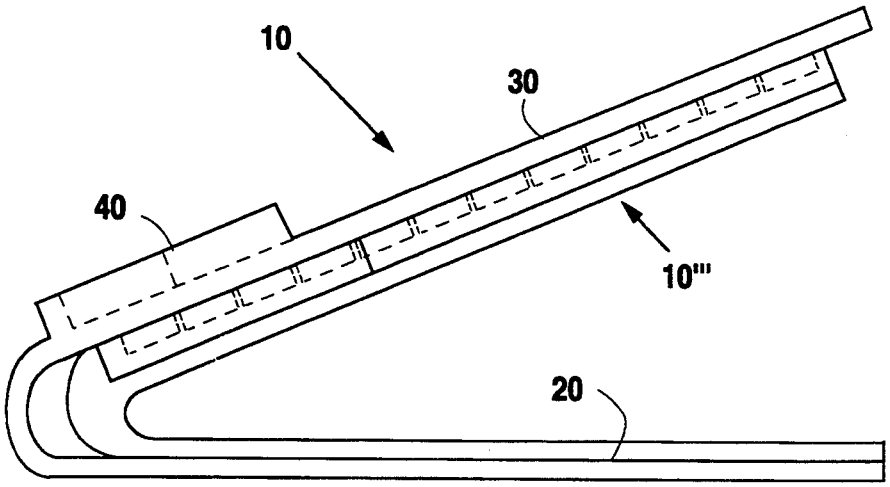
FIG. 2 is a side view of the cell well plate holder shown in FIG. 1 in combination with a cell well marking system.

FIGS. 2 and 3 show an alternate method of positioning cell well marking system 100 by using a second cell well plate holder 10‴. In this embodiment, cell well marking system 100 is placed in holder 10‴ (FIG. 3) in either the lengthwise or widthwise position, depending on the position of the cell well plate (not shown) with which it is to be used (FIG. 2). Holder 10‴ is then slid into holder 10 or 10″ (FIG. 2) so that each individual indicator 1 on cell well marking system 100 is positioned directly beneath a well of the cell well plate.

Either of the above described methods for positioning the cell well marking system 100 can be used in conjunction with the second preferred embodiment in FIG. 8, although such a configuration is not illustrated.

Figure 6A:
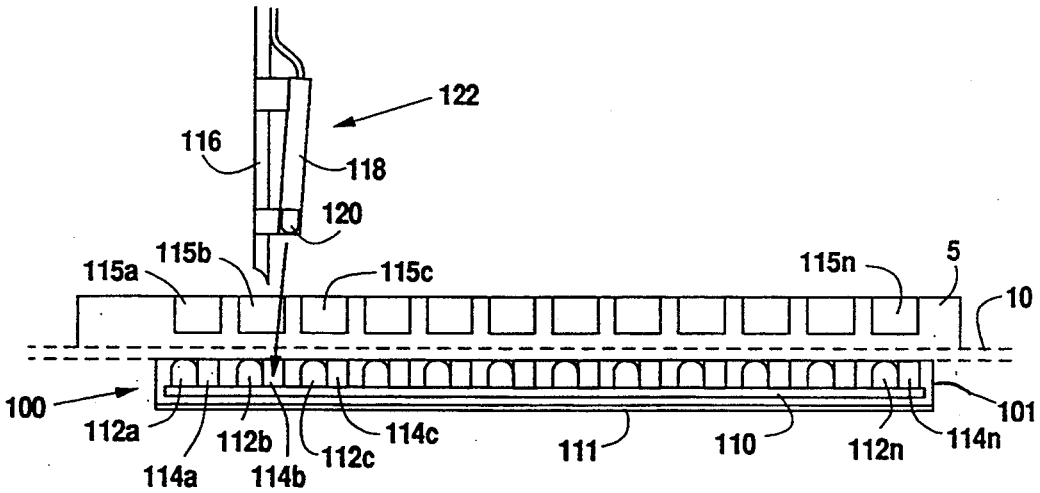
FIG. 6A is a side view of a first embodiment of the cell well marking system in place.

Reference is now made to FIG. 6A for a detailed description of a first embodiment of the cell well marking system of the present invention. FIG. 6A is a side view of the first embodiment of the cell well marking system shown positioned beneath receiving face 30 of cell well plate holder 10 which in turn supports cell well plate 5. Cell well marking system 100 comprises indicator array 101 and pipette assembly 122. Indicator array 101 consists of circuit board 110 mounted within circuit board holder 111 and configured as a cell well plate to fit in cell well plate holder 10‴ as shown in FIG. 3 or in cell well plate holder 10 as shown in FIG. 5. In FIG. 3, indicator array 101 is positioned atop cell well plate holder 10‴ in a manner that allows it to be inserted behind and into a similar cell well plate holder 10 as shown in FIG. 2. Indicator array 101 may also be inserted in the appropriate brackets 70–73 shown in FIG. 5 that will appropriately position the array beneath receiving face 30 of cell well plate holder 10.

Indicator array 101 comprises a rectangular array of LED/phototransistor pairs comprised of LEDs 112*a-n* and phototransistors 114*a-n*. These LEDs 112 and phototransistors 114 are arranged in the rectangular array so as to be positioned beneath each cell well 115*a-n* in cell well plate 5. Each LED/transistor pair (112/114) is associated with an individual cell well 115 in cell well plate 5.

The size of indicator array 101 might be determined by the size of cell well plate 5 so that there is a specific LED/phototransistor pair (112/114) associated with each cell well 115. Indicator array 101 might be of a size that could accommodate the largest possible cell well plate 5 and would allow the use of any smaller size cell well plates 5 such that some portions of indicator array 101 would not have to be used.

In any case, indicator array 101 is utilized in this first embodiment in conjunction with pipette assembly 122. Pipette assembly 122 comprises pipette tip 116, LED holder 118, and IR LED 120. A sample contained within the pipette is dispensed through pipette tip 116 into a particular cell well 115. When pipette tip 116 enters a cell well 115, IR LED 120 directs infrared illumination into cell well 115 through transparent cell well plate holder 10 and phototransistor 114. Phototransistor 114 then signals, by way of circuitry described in more detail below, LED 112 to turn on. Illuminating LED 112 indicates that the particular cell well 115 associated with LED 112 has been accessed by pipette tip 116. Typically, this would indicate the dispensing of a sample into that particular cell well. Adjustments to the sensitivity of the circuitry associated with the triggering of LED 112, discussed in more detail below, would prevent any erroneous triggering of a particular cell well LED 112.

Initially, indicator array 101 is reset so that none of LEDs 112*a-n* are illuminated. As pipette assembly 122 accesses each cell well 115*a-n* and dispenses therein a sample, infrared illumination from IR LED 120 triggers the respective phototransistor 114 and illuminates the respective visual LED 112. At any point in the process of dispensing samples within cell well plate 5, the test operator can determine exactly which cell wells 115 have been accessed and which remain to be used.

Figure 6B:
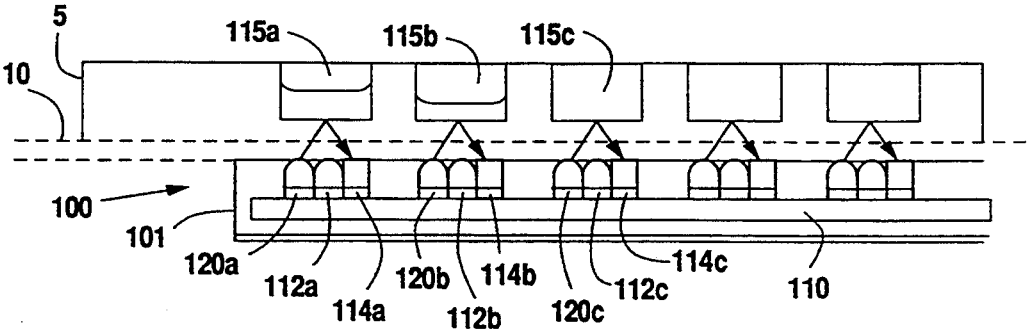
FIG. 6B is a detailed side view of a second embodiment of the cell well marking system in place.

Reference is now made to FIG. 6B for an alternative embodiment of the cell well marking system of the present invention. FIG. 6B is a detailed side view of the second embodiment of the cell well marking system showing a section of cell well plate 5 and the associated cell well indicator array 101 therebelow. In place of the array of LED/phototransistor pairs 112/114 shown in FIG. 6A, there is a corresponding array of IR LED/-LED/phototransistor groups which are similarly positioned beneath each of the individual cell wells 115. Indicator array 101 shown in FIG. 6B may be positioned in either of the configurations described above with respect to FIG. 6A. The advantage of the cell well marking system shown in FIG. 6B is that it does not require the use of pipette assembly 122. Instead of receiving an infrared illuminating signal from the pipette, changes in the condition of individual cell wells 115 are determined by infrared illumination from below the cell well itself.

Indicator array 101 comprises circuit board 110 on which is mounted an array of IR LED/LED/phototransistor groups (120/112/114), each group associated with a specific cell well 115. Cell well plate holder 10 is transparent and, therefore, allows the transmission of infrared light from IR LED 120 through cell well plate holder 10 to a point where it is reflected off the base of a specific cell well 115. The reflection of this infrared light illuminates phototransistor 114 adjacent to LED 112. The reflectivity of the base of a cell well 115 is altered by the presence or absence of a sample within that cell well. Whether the sample is clear or opaque, the reflectivity of the bottom of the cell well will change as a result of the presence or absence of sample. By circuitry means described in more detail below, therefore, the presence or absence of a sample within a cell well can be determined by a measure of the reflectivity or a measure of the reflected IR signal off of the base of the cell well. IR LEDs 120, therefore, constantly illuminate the base of the adjacent cell well 115 and the reflective condition is measured by phototransistor 114. The circuitry associated with phototransistor 114, described in more detail below, is set to trigger a visual LED 112 when the reflectivity of the cell well base is altered outside of a specific range. The existence of a reflected signal outside of a particular range would be associated with, and be indicative of, the presence of a sample within that particular cell well. The phototransistor circuitry would then illuminate visual LED 112 to indicate to the test operator that a sample is present or has been deposited within a particular cell well. It is anticipated that the sample is of such a nature that an LED illuminated beneath it would be detectable by the test operator.

Reference is now made to FIG. 7 for an electronic schematic showing the circuitry associated with both the cell well marking system described in FIGS. 6A and 6B. FIG. 7 shows three general circuit elements that together allow the operation of the cell well marking systems described above. The first circuit element shown in FIG. 7 is transmitter circuitry 150, which incorporates IR LED 156, either on pipette assembly 122 as in FIG. 6A, or beneath cell well plate holder 10 as in FIG. 6B. In either case, transmitter circuitry 150 directs an infrared signal towards receiving circuitry 170. Receiving circuitry 170 is adjustable so as to allow for the use of either the cell well marking embodiment shown in FIG. 6A or the embodiment shown in FIG. 6B. The circuitry adjustments that distinguish these methods are described in more detail below. Finally, FIG. 7 describes a third circuit element, illuminating circuitry 190 which contains visual LED 210 to indicate to the test operator that a particular cell well has been utilized.

Transmitting circuitry 150, in addition to IR LED 156, comprises transistors 152 and 154, which in the preferred embodiment are a 2N2907 transistor and a 2N222 and 154, which in the preferred embodiment are a 2N2907 transistor transistor, respectively. The combination of resistors 158 (22KΩ) and 160 (2.2MΩ) and capacitor 162 (0.02 $\mu f$) in transmitter circuitry 150 allow the pulsed switching of transistor 154 to create a current through LED 156 to direct a pulsed IR signal to receiving circuitry 170.

Receiving circuitry 170 comprises phototransistor 172 which is sensitive to infrared frequencies in the range emitted by LED 156. The current generated by phototransistor 172 is amplified by way of amplifier 174, capacitor 184 and resistor 178. In the preferred embodiment, amplifier 174 is one-half of a 1458 integrated circuit (IC) chip, resistor 178 is a 1MΩ resistor, and capacitor 184 has a value of 0.01 $\mu f$. The amplified signal is then compared to a preset value by means of comparator 176. The threshold value for comparator 176 is set by way of variable resistor 182. Comparator 176 in the preferred embodiment is a second half of the 1458 chip, resistor 182 is a 10KΩ variable resistor, and resistor 180 is a 100Ω resistor. Receiving circuitry 170, therefore, provides a triggering signal through capacitor 186 with a value of 0.1 $\mu f$ to indicator circuitry 190.

The basic element of indicator circuitry 190 is a 555 timer IC chip 194. When the output of comparator 176 goes high, indicating the presence of infrared illumination on phototransistor 172, timer 194 switches visual LED 210 into a conducting state. Illuminating circuitry 190 consists of the necessary biasing and reset connections to timer 194 to appropriately illuminate LED 210. Transistor 192 in the preferred embodiment is a 2N2907 transistor that is switched by the operation of comparator 176 and triggers timer 194. Capacitors 200 and 202 in the preferred embodiment have values of 3.1 $\mu f$ and 0.01 $\mu f$, respectively. Biasing resistor 196 is a 4.7KΩ resistor in the preferred embodiment and variable resistor 198 is a 1MΩ variable resistor. Blocking diode 206 is a 1N91 diode from high voltage to pin 3 of timer 194. Relay coil 204 allows the circuitry of timer 194 to be reset when the LEDs in the array are to be extinguished. Resistor 208 in the preferred embodiment in series with visual LED 210 is on the order of 1KΩ.

As described above, the basic circuitry shown in FIG. 7 can be utilized with either the embodiment shown in FIG. 6 or the embodiment shown in FIG. 6A. With the embodiment shown in FIG. 6, the transmitter circuitry 150 of FIG. 7 is incorporated into the pipette assembly 122. Receiving circuitry 170 is adjusted to be sensitive to the presence of infrared illumination from IR LED 156 on phototransistor 172. The threshold value necessary to appropriately indicate the insertion of pipette tip 116 into a cell well can be set by threshold resistor 182. Therefore, when the output of phototransistor 172 reaches a certain value, indicating access by the pipette, receiving circuitry 170 triggers illuminating circuitry 190 to light LED 210.

In the alternative embodiment, shown in FIG. 6B, IR LED 156 and phototransistor 172 are actually the adjacent pair of IR LED 120 and phototransistor 114 shown. In this embodiment, phototransistor 172 is set to be sensitive to the reflection of the infrared signal from LED 156 off of the base of an individual cell well. Depending upon the reflective characteristics of the cell well, in the presence or absence of a sample therein, comparator 176 can be configured as is shown in FIG. 7 or may have its positive and negative inputs inverted so as to allow indicator circuitry 190 to trigger below a specified threshold level. When the reflective signal entering phototransistor 172 drops below a given value, the output comparator 176 can be configured to then go high and trigger indicator circuitry 190. The only adjustments necessary to distinguish between the method shown in FIG. 6A and the method shown in FIG. 6B involve the arrangement of comparator 176 and the threshold value set by variable resistor 182. Otherwise the high signal output by comparator 176 should appropriately trigger indicator circuitry 190 to illuminate LED 210.

We claim:

1. A device for holding a standard laboratory cell well plate, said cell well plate being rectangular with two pairs of parallel sides, said first pair of parallel sides being longer than said second pair of parallel sides, said device consisting of:

a receiving member having a top edge, a bottom edge, a front face and a rear face, said front face of said receiving member for supporting said standard, rectangular cell well plate in either a first orientation wherein said first pair of parallel sides of said cell well plate are parallel to said bottom edge of said receiving member, or in a second orientation wherein said second pair of parallel sides of said cell well plate are parallel to said bottom edge of said receiving member;

a propping member attached to said receiving member for positioning of said front face of said receiving member at an obtuse angle to a horizontal surface upon which said device is positioned;

a retaining member having a first end, a second end, and a midsection for maintaining said cell well plate in said first orientation or said second orientation on said front face of said receiving member, said retaining member being permanently attached to said front face of said receiving member proximate to said bottom edge of said receiving member;

said first end of said retaining member being stepped shaped with a first step and a second step, said first step having a top edge and a side edge, said second step having a top edge and a side edge, said side edge of said second step and said side edge of said first step perpendicular to said midsection of said retaining member, said top edge of said first step and said top edge of said second step parallel to said midsection;

said second end of said retaining member being stepped shaped with a first step and a second step, said first step having a top edge and a side edge, said second step having a top edge and a side edge, said side edge of said second step and said side edge of said first step perpendicular to said midsection of said retaining member, said top edge of said first step and said top edge of said second step being parallel to said midsection;

said mid-section of said retaining member and said side edge of said second step of said first end of said retaining member and said side edge of said second step of said second end of said retaining member utilized to prevent lateral movement of said cell well plate across said front face of said receiving member when said cell well plate is in said second orientation; and said top edge of said second step and said side edge of said first step of said first end of said retaining member and said top edge of said second step and said side edge of said first step of said second end of said retaining member utilized to prevent lateral movement of said cell well plate across said front face of said receiving member when said cell well plate is in said first orientation.

2. The cell well plate holder according to claim 1 further comprising an adjusting means for altering said obtuse angle between said front face of said receiving member and said horizontal surface upon which said device is positioned.

3. The cell well plate holder according to claim 2 wherein said propping member has a forward edge, said forward edge of said propping member being attached to said bottom edge of said receiving member, and wherein said adjusting means comprises:

a threaded screw;

a nut defining a threaded aperture for receiving said threaded screw; and said bottom edge of said receiving member and said forward edge of said propping member having alternate hinge segments defining a horizontal bore for receiving said threaded screw.

* * * * *